United States Patent [19]

Cochran

[11] Patent Number: 4,665,716

[45] Date of Patent: May 19, 1987

[54] FLUID FLOW CONTROL SYSTEM

[76] Inventor: Robert Cochran, 5404 Sunset Way N., Lakeland, Fla. 33805

[21] Appl. No.: 835,611

[22] Filed: Mar. 3, 1986

Related U.S. Application Data

[63] Continuation-in-part of Ser. No. 652,849, Sep. 21, 1984, Pat. No. 4,573,327.

[51] Int. Cl.[4] ..... F25B 43/00

[52] U.S. Cl. ..... 62/503; 62/504

[58] Field of Search ..... 62/218, 219, 503, 504, 62/238.6

[56] References Cited

U.S. PATENT DOCUMENTS

| | | | |
|---|---|---|---|
| 3,280,589 | 10/1966 | Papapanu | 62/218 |
| 3,315,486 | 4/1967 | Chien et al. | 62/504 X |
| 3,370,440 | 2/1968 | Kellie | 62/503 |
| 3,420,071 | 1/1969 | Bottum | 62/503 |
| 3,488,678 | 1/1970 | Wagner | 62/503 |
| 3,643,466 | 2/1972 | Bottum | 62/503 |
| 4,194,367 | 3/1980 | Lavik | 62/503 |
| 4,474,035 | 10/1984 | Amin et al. | 62/503 |
| 4,488,413 | 12/1984 | Bottum | 62/503 |

*Primary Examiner*—Lloyd L. King

*Attorney, Agent, or Firm*—A. W. Fisher, III

[57] ABSTRACT

A fluid flow control system for use with a heat exchange apparatus which includes a first heat exchange or condensor to extract heat from the heat exchange apparatus, a compressor and a second heat exchange or evaporator to provide heat to the heat exchange apparatus, the fluid flow control system comprises a system charge control device operatively coupled between the first and second heat exchanges to regulate the flow of refrigerant therebetween.

16 Claims, 5 Drawing Figures

FLUID FLOW CONTROL SYSTEM

CO-PENDING APPLICATIONS

This application is a continuation-in-part of application Ser. No. 652,849 filed on Sept. 21, 1984, now U.S. Pat. No. 4,573,327.

BACKGROUND OF THE INVENTION

1. Field of the Invention

A fluid flow control system for use with a heat exchange apparatus comprising a system charge control device to regulate the active change of refrigerant in the system and the flow of refrigerant between the condensor and evaporator.

2. Description of the Prior Art

Numerous heating and cooling apparatus including condensors, compressors and evaporators have been developed for use with fluorocarbon refrigerants such as Freon. For example, U.S. Pat. No. 3,965,694 discloses an apparatus for heating or cooling including a first heat exchange to transfer heat between the refrigerant and the atmosphere and a second subterranean heat exchange to transfer heat between the earth and the refrigerant. A capillary tube restricting device is positioned in the refrigerant line between the first and second heat exchanges to liquefy the refrigerant before reaching the subterranean heat exchange U.S. Pat. No. 2,513,373 discloses a heat pump for heating or cooling a fluid utilizing a closed circuit refrigerant loop. A closed circuit water line circulates water through a pair of subterranean heat exchanges. A heat exchange which is coupled to both the closed circuit refrigerant loop and the closed circuit water line transfers heat energy between the independent water and refrigerant systems.

U.S. Pat. No. 2,529,154 discloses a solar heating system where water is circulated within a closed system coupled to a solar energy heat absorber while the refrigerant is circulated through a second closed system.

Other examples of the prior art are disclosed in U.S. Pat. Nos: 1,958,087; 2,448,315; 2,512,869; 2,693,939; 2,968,934; 3,175,370 3,226,940; 3,315,481; 3,392,541; 3,499,296; 3,564,862; 4,012,920; 4,049,407; 4,091,994; 4,187,695; 4,194,367; 4,320,630; 4,488,413; France No. 487762 and Sweden No. 59350.

In any refrigeration and heat pump system the three major components; compressor, condensor and evaporator require certain refrigerant conditions in order to operate at optimum efficiency. For optimum efficiency the compressor requires a dry or totally evaporated refrigerant with little or no superheat at the compressor inlet. The condensor requires the refrigerant outlet pressure to be just sufficient to force all fluid to condense or become liquid just as the refrigerant reaches the outlet or a point near the outlet if subcooling is desired. The evaporator should, on the other hand, receive only liquid refrigerant at the evaporator inlet. Evaporation should be complete just as the refrigerant reaches the outlet. In this condition, the evaporator is said to be "flooded". However, no unevaporated refrigerant should leave at the outlet.

In conventional refrigeration systems, refrigerant flow controls have many shortcomings which cause inefficient operation of the three major components previously described. For example, thermal expansion valves control the output of the evaporator and input to the compressor inefficiently as the superheat at the compressor inlet, evaporator outlet is held at about 12°

F. Such valves are unable to control conditions in the condensor at all. Electric expansion valves exhibit similar shortcomings except that they are able to hold the superheat at the compressor inlet closer to the desired 0° F. Both thermal and electric expansion valves are unable to control systems with relatively long evaporators such as long supermarket coolers and earth tap evaporators, as these systems "hunt" wildly.

Capillary tubes, "automatic" expansion valves and fixed orifices control the conditions in all three major components very inefficiently. This is especially true in systems having condensors and/or evaporators with wide temperature and pressure excursions during each run cycle.

With conventional flow controls "Blow-through" of uncondensed vapor at the condensor outlet is not uncommon. Unfortunately conventional flow controls are unable to provide fixed subcooling including zero subcooling in the condensor or a continuously flooded evaporator without returning unevaporated refrigerant to the compressor.

The present invention provides subcooling and blow-through control, with the additional desired result that liquid refrigerant flow from the condensor is at exactly the rate at which the condensor and the entire system is able to produce liquid condenstate.

Further the present invention provides a constant smooth flow of liquid refrigerant to the evaporator and a constant smooth flow of vapor refrigerant, of low superheat, from the evaporator to the compressor providing an efficient, effective and reliable fluid flow control system. In short, the present invention provides the desired optimum refrigerant conditions at the condensor, evaporator and compressor at all times during operation.

SUMMARY OF THE INVENTION

The present invention relates to a fluid flow control system comprising a system charge control device for use in combination with a heat exchange apparatus including a first heat exchange to extract heat, a compressor, and a second heat exchange to provide heat.

The system charge control device comprises a thermally encapsulated enclosed liquid/vapor reservoir. The lower or inlet portion of the thermally encapsulated enclosed liquid/vapor reservoir is in fluid communication with the outlet of the second heat exchange or evaporator while the upper or outlet portion of the thermally encapsulated enclosed liquid/vapor reservoir is in fluid communication with the inlet of the compressor.

A liquid evaporating means comprising a vertical evaporator tube may be directly coupled to an inlet tube in the lower portion of the system charge control device. The vertical evaporator tube is in fluid communication with the thermally encapsulated enclosed liquid/vapor reservoir through an orifice formed in the vertical evaporator tube disposed near the bottom of the vertical evaporator tube such that the liquid level in the thermally encapsulated enclosed liquid/vapor reservoir and the vertical evaporator tube are substantially the same. The refrigerant charge in the system is such that when the system is operating the liquid level in the thermally encapsulated enclosed liquid/vapor reservoir, and therefore in the evaporator tube, is always above the top of the inlet tube. Whenever vapor entering at the inlet tube is superheated, meaning the system is undercharged and the evaporator is not "flooded", the superheated vapor bubbles upward through the liquid standing in the vertical evaporator tube, thereby evaporating some of the liquid, reducing the superheat of the vapor and placing more refrigerant in circulation in the system. This process continues until the evaporator becomes "flooded" and equilibrium is reached when refrigerant vapor at zero superheat and containing no unevaporated refrigerant reaches the inlet of the system charge control device. In the event that the system is overcharged and the evaporator becomes over-flooded and liquid in form of mist or droplets begins to arrive within the vapor at the inlet of the system charge control device, the tiny droplets or mist are trapped in the liquid in the vertical evaporator tube.

Thus it can be seen that the system charge control device serves to prevent any liquid or unevaporated refrigerant from reaching the compressor, serves as a liquid reservoir to supply the varying active refrigerant charge requirements of the system, serves to evaporate refrigerant as necessary to keep the evaporator flooded and prevent the building of superheat at the compressor entrance, while continuously passing the compressor oil entrained in the refrigerant.

While the preferred embodiment following herein utilizes the present invention in an application where conventional flow devices cannot function properly, it is to be understood that the present invention will also provide improvement in efficiency in applications where conventional flow devices are normally applied, such as in air conditioning, heat pumps and refrigeration systems, and will greatly simplify many of such applications.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several view of the drawings.

DETAILED DESCRIPTION OF THE PREFERRED EMBODIMENT

Figure 1:
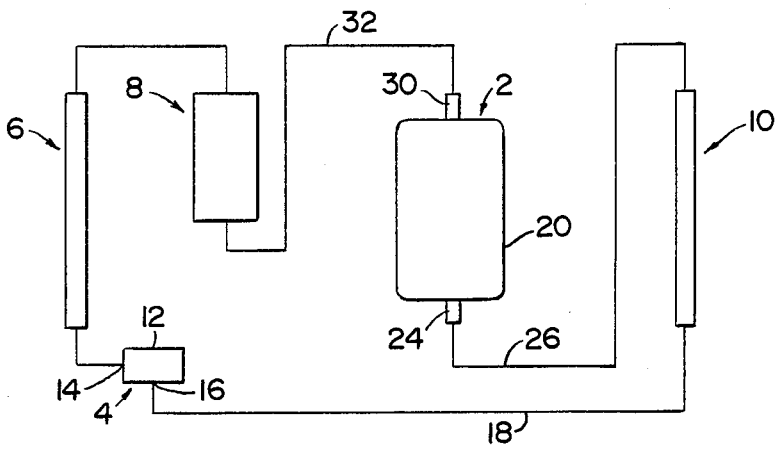
FIG. 1 is a schematic view of the fluid flow control system with the heat exchange apparatus.

As shown in FIG. 1, the present invention relates to a fluid flow control system comprising a system charge control device generally indicated as 2 for use in combination with a liquid flow control device generally indicated as 4 and a heat exchange apparatus including a first heat exchange (condensor) to extract heat, compressor and second heat exchange (evaporator) to provide heat generally indicated as 6, 8 and 10 respectively.

As shown in FIG. 1, the liquid flow control device 4 comprises an enclosed liquid/vapor reservoir 12 including a first liquid port 14 in fluid communication with the lower or outlet portion of the first heat exchange 6 and a second liquid port 16 in fluid communication with the second heat exchange 10 through a liquid conduit 18.

Figure 2:
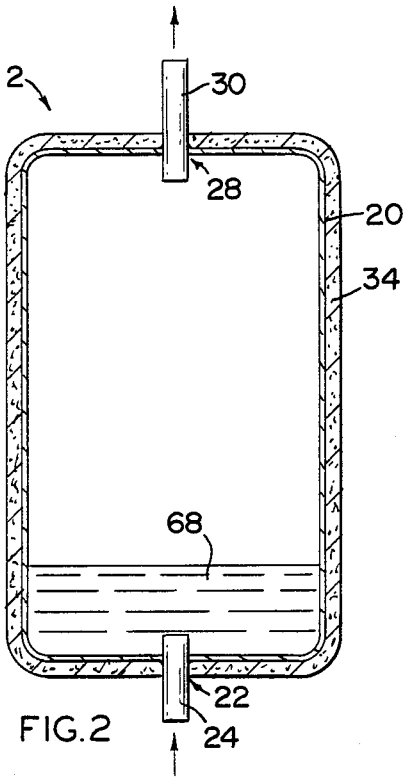
FIG. 2 is a detailed cross-sectional side view of the system charge control device.
Figure 3:
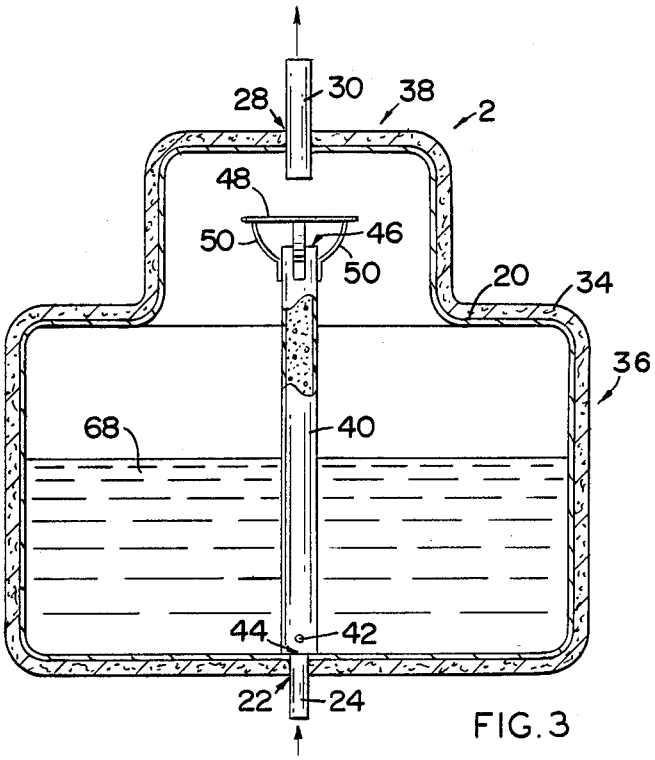
FIG. 3 is a detailed cross-sectional side view of an alternate system charge control device.
Figure 4:
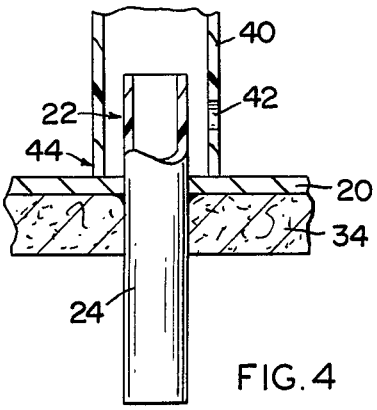
FIG. 4 is a partial cross-sectional side view of the vertical evaporator tube and vapor/liquid inlet tube.

As shown in FIGS. 1 through 3, the system charge control device 2 comprises an enclosed liquid/vapor reservoir 20. The lower portion of the enclosed liquid/-vapor reservoir 20 is in fluid communication with the outlet of the second heat exchange 10 through a vapor/-liquid inlet port and vapor/liquid inlet tube indicated as 22 and 24 respectively and a vapor conduit 26 and the compressor 8 through a vapor outlet port and vapor outlet tube indicated as 28 and 30 respectively and vapor conduit 32 (FIG. 1). The entire enclosed liquid/-vapor reservoir 20 is thermally enclosed in an insulating covering or thermally encapsulating material 34.

To accommodate heat exchange apparatus of relatively large refrigerant requirements, the thermally encapulated enclosed liquid/vapor reservoir 20 may comprise a lower enlarged portion 36 and upper reduced portion 38 to provide proper vapor flow. A liquid evaporating means comprising a vertical evaporator tube 40 including a liquid inlet orifice, evaporator inlet port, and evaporator outlet port indicated as 42, 44 and 46 respectively and a fluid velocity reducing means comprising a liquid/vapor deflector member 48 coupled to the upper portion of the vertical evaporator tube 40 by an interconnecting member 50 adjacent the evaporator outlet port 46. The liquid/vapor deflector member 48 deflects or redirects the vertical movement of refrigerant rising within the vertical evaporator tube 40 radially outward into the upper reduced portion 38 (FIG. 3).

Figure 5:
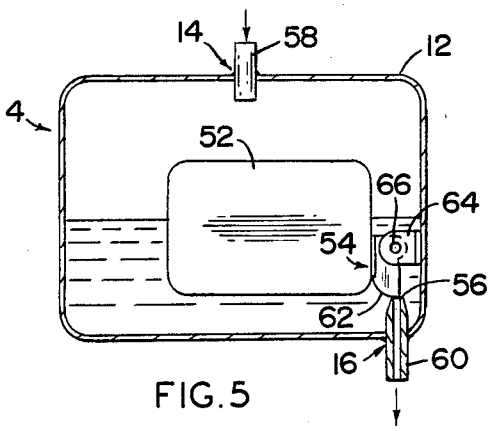
FIG. 5 is a detailed cross-sectional side view of the liquid flow control device.

As best shown in FIG. 5, the liquid flow control device 4 comprises the enclosed liquid/vapor reservoir 12 having a liquid metering means disposed within. The liquid metering means comprises a hollow float 52 and, a movable metering member 54 disposed in variable restrictive relationship to a liquid metering orifice 56. Affixed to the enclosed liquid/vapor reservoir 12 is a liquid inlet tube or port 58 in fluid communication with the lower or outlet portion of the first heat exchange 6. The liquid metering orifice 56 through a liquid outlet tube or port 60 is in fluid communication with the second heat exchange 10 through the liquid conduit 18. The movable metering member 54 comprises an arcuate lower element 62 pivotally attached to a mounting member 64 by interconnecting element 66.

As shown in FIGS. 1 and 5, refrigerant entering the liquid flow control device 4 through the liquid inlet port 58 and leaving through the liquid metering orifice 56 will be greatly restricted when the hollow float 52 is supported only by the bottom of the enclosed liquid/vapor reservoir 12 and the movable meterrng member 54 is in maximum restrictive relationship with the liquid metering orifice 56, with the result that pressure increases in the first heat exchange 6 and condensation of vapor within the first heat exchange 6 increases until only liquid reaches the enclosed liquid/vapor reservoir 12 through the liquid inlet port 58. As such liquid increases the liquid level in enclosed liquid/vapor reservoir 12 and the hollow float 52 rises correspondingly. The movable metering member 54 then moves to a less restrictive relationship with the liquid metering orifice 56 thereby allowing the rate of liquid flow through the liquid metering orifice 56 to increase as the liquid level increases, until equilibrium is reached when the rate of liquid flow through the liquid metering orifice 56 equals the rate of liquid flow entering the liquid inlet port 58.

In the event any substantial amount of vapor reaches enclosed liquid/vapor reservoir 12 through the liquid inlet port 58, the liquid level in the enclosed liquid/vapor reservoir 12 will be forced downward with a resulting drop in the level of the hollow float 52 and increased restricting relationship of the movable metering member 54 with the liquid metering orifice 56. Such increased restriction again increases the pressure at the outlet of the first heat exchange 6 with the result that more liquid and less vapor is allowed to reach the enclosed liquid/vapor reservoir 12 through the liquid inlet port 58, thereby causing the hollow float 52 to again move upward and the movable metering member 54 to move to a lesser restrictive relationship with the liquid metering orifice 56 until equilibrium is restored.

Conversely if no vapor reaches the enclosed liquid/vapor reservoir 12 the vapor therein will gradually condense allowing the hollow float 52 to rise, with the result that the movable metering member 54 moves to a lesser restrictive relationship with the liquid metering orifice 56 and the rate of flow of liquid out through the liquid metering orifice 56 increases until the liquid level decreases to the point that a very small amount of vapor enters the enclosed liquid/vapor reservoir 12 to again force the hollow float 52 downward until equilibrium is again restored.

Thus it can be seen that in operation no vapor can pass through the liquid flow control 4 and all vapor from the compressor 8 is forced to condense within the first heat exchange 6 except the miniscule amount that condenses within enclosed liquid/vapor reservoir 12.

In operation, the thermally encapsulated enclosed liquid/vapor reservoir 20 surrounded with thermal encapsulating material 34 retains a variable amount of liquid refrigerant 68 stored therein. The vapor/liquid inlet tube 24 is located such that refrigerant arriving from the evaporator 10 is discharged into the thermally encapsulated enclosed liquid/vapor reservoir 20 below the level of the stored liquid refrigerant. The thermal encapsulating material 34 around the thermally encapsulated enclosed liquid/vapor reservoir 20 causes the temperature of the liquid refrigerant 68 within to move rapidly toward the temperature dictated by the suction pressure imposed upon the thermally encapsulated enclosed liquid/vapor reservoir 20 by the compressor 8. The operating temperature of the liquid refrigerant 68 within the thermally encapsulated enclosed liquid/vapor reservoir 20 is directly proportional to the suction pressure of the compressor 8. As shown in FIG. 3, the level of liquid refrigerant 48 within the thermally encapsulated enclosed liquid/vapor reservoir 20 and vertical evaporator tube 40 is maintained substantially the same through the inlet orifice 42.

When the system has the proper active charge the refrigerant arriving at the vapor/liqid inlet port 22 will be "saturated". This means that the refrigerant is totally vapor without superheat. In this instance, the refrigerant bubbles upward through the stored liquid refrigerant 68 which is at the same temperature and exits the vapor outlet port 28 without change. It should be noted that this can only occur when evaporation becomes complete at the outlet of the evaporator 10 which means that the evaporator 10 is flooded.

However, if for any reason evaporation is not complete at the exit of the evaporator 10, the unevaporated liquid will be carried into the system charge control device 2 and trapped by the liquid refrigerant 68 therein. Trapping the unevaporated liquid effectively removes refrigerant from the active charge (removes it from circulation) and this continues until the refrigerant arriving at the vapor/liquid inlet port 22 contains no unevaporated droplets or mist and the proper active charge is restored.

Conversely if for any reason evaporation is complete substantially before the refrigerant reaches the outlet of the evaporator 10, the vapor will take on "superheat" in the remaining portion of the evaporator 10 and conduit 26 and will arrive at the vapor/liquid inlet port 22 in a superheated condition. Superheated bubbles passing upward through the stored liquid refrigerant 68 (being hotter than the stored liquid) causes some of the stored liquid to evaporate and leave at the vapor outlet port 28 as a vapor in active circulation. This continues until the additional active charge is sufficient to "flood" the evaporator 10 (provide unevaporated refrigerant at the exit of the evaporator 10) and vapor/liquid inlet port 22 of system charge control device 20 and the proper active system charge is restored.

In systems where the condensor 6 gradually heats up during the run cycle, the back pressure to the compressor 8 increases and more refrigerant is required in active circulation to provide the higher pressure. In systems where the evaporator 10 gradually cools down during the run cycle less refrigerant is required in active circulation due to the reduced pressure in the evaporator 10. As these changes or any other changes in active charge requirement occur, the correct charge will immediately and continuously be restored by the action of the system charge control device 20.

Use of the system charge control device 2 in conjunction with the liquid flow control device 4 or as disclosed in applicant's copending application, will provide optimum refrigerant conditions in the condensor 6, evaporator 10 and compressor 8.

When the system charge control device 2 is used in conjunction with other liquid flow control devices such as capillary tubes and fixed orifices, the operation of the evaporator 10 and compressor 8 will be improved as the evaporator 10 will be properly "flooded" and the compressor 8 will receive vapor that is dry but at near zero superheat at all times. In addition, the operation of the condensor 6 will be enhanced by the increased throughput provided by the more efficient compressor 8 and evaporator 10.

Compressor lubricating oil entrained in the refrigerant arriving at the system charge control device 2 through inlet 22 will at first be trapped within the liquid in the system charge control device 2. As such trapping continues, the concentration of oil in the liquid increases until oil and vapor bubbles are formed above the surface of the liquid and the bubbles become entrained in the vapor leaving the thermally encapsulated enclosed liquid/vapor reservoir 20. Any bubbles containing substantial liquid refrigerant are relatively heavy and fall back into the liquid upon entering the large cross section of vapor above the liquid refrigerant 68. Thus the compressor oil reaches a certain concentration within the liquid 48. The oil is effectively and continuously passed through the system charge control device 2 to return to the compressor 8. A small amount of compressor oil is added to the system to compensate for that amount trapped in the liquid refrigerant 68 in the system charge control device 20.

It will thus be seen that the objects set forth above, and those made apparent from the preceding description are efficiently attained and since certain changes may be made in the above construction without departing from the scope of the invention, it is intended that all matter contained in the above description or show in the accompanying drawings shall be interpreted as illustrative and not in a limiting sense.

It is also to be understood that the following claims are intended to cover all of the generic and specific features of the invention herein described, and all statements of the scope of the invention which as a matter language, might be said to fall therebetween.

Now that the invention has been described, what is claimed is:

1. A fluid flow control system for use with a heat exchange apparatus including a compressor, a first heat exchange to extract heat from the heat exchange apparatus and a second heat exchange to provide heat to the heat exchange apparatus, said fluid flow control system comprising a system charge control device operatively coupled between the compressor and the second heat exchange to regulate the flow of refrigerant therebetween, said system charge control device comprises an enclosed liquid/vapor reservoir to retain sufficient liquid refrigerant to provide adequate refrigerant over a range of operating conditions of the heat exchange apparatus, said enclosed liquid/vapor reservoir having a vapor/liquid inlet port formed in the lower portion thereof to receive refrigerant from the second heat exchange and a vapor outlet port formed in the upper portion thereof to supply vaporized refrigerant to the compressor whereby the refrigerant reaching said vapor/liquid inlet port passes upward through the liquid refrigerant in said enclosed liquid/vapor reservoir to evaporate liquid refrigerant in said enclosed liquid/vapor reservoir to reduce superheat of vaporized refrigerant from the second heat exchange or to trap liquid refrigerant from the second heat exchange within said enclosed liquid/vapor reservoir and said enclosed liquid/vapor reservoir being thermally encapsulated to insulate said enclosed liquid/vapor reservoir from ambient conditions such that the temperature of the liquid refrigerant within said enclosed liquid/vapor reservoir corresponds to the suction pressure of the compressor to control the proper active charge of refrigerant circulatory throughout the heat exchange apparatus.

2. The fluid flow control system of claim 1 wherein said system charge control device includes an evaporator tube having an orifice formed in the lower portion thereof, an evaporator inlet port and an evaporator outlet port formed on opposite ends of said evaporator tube such that the liquid refrigerant level within said evaporator tube is substantially the same as the liquid refrigerant level within said thermally encapsulated enclosed liquid/vapor reservoir whereby refrigerant passes through the interior of said evaporator tube thereby trapping any liquid in the refrigerant or reducing superheat of the vapor arriving at said vapor/liquid inlet port by evaporating a portion of the liquid refrigerant within said evaporator tube.

3. The fluid flow control system of claim 2 wherein the portion nearest the outlet of said thermally encapsulated enclosed liquid/vapor reservoir is reduced in cross-sectional area relative to the liquid refrigerant storage portion of said thermally encapsulated enclosed liquid/vapor reservoir to provide adequate liquid refrigerant storage within said reservoir and to provide the proper velocity of the refrigerant approaching the said outlet port such that oil/vapor bubbles proceed to exit said outlet port and liquid refrigerant is retained within said thermally encapsulated enclosed liquid/vapor reservoir.

4. The fluid flow control system of claim 2 wherein said system charge control device further includes a liquid/vapor tube disposed between said vapor/liquid port and said evaporator tube to feed refrigerant from the second heat exchange to the interior of said evaporator tube.

5. The fluid flow control system of claim 2 wherein said system charge control device further includes a fluid velocity reducing means adjacent said evaporator outlet port to reduce the velocity of the refrigerant from said evaporator tube.

6. A fluid flow control system for use with a heat exchange apparatus including a compressor, a first heat exchange to extract heat from the heat exchange apparatus and a second heat exchange to provide heat to the heat exchange apparatus, said fluid flow control system comprising a system charge control device operatively coupled between the compressor and the second heat exchange to regulate the flow of refrigerant therebetween, said system charge control device comprises an enclosed liquid/vapor reservoir to retain sufficient liquid refrigerant to provide adequate refrigerant over a range of operating conditions of the heat exchange apparatus, said enclosed liquid/vapor reservoir having a vapor/liquid inlet port formed therein to receive refrigerant from the second heat exchange and a vapor outlet port formed therein to supply vaporized refrigerant to the compressor, said system charge control device including an evaporator tube in fluid communication with said vapor/liquid inlet port, said evaporator tube having an orifice formed on the lower portion thereof to feed liquid refrigerant to the interior of said evaporator tube from said enclosed liquid/vapor reservoir, an evaporator inlet port and an evaporator outlet port formed on opposite ends of said evaporator tube such that refrigerant reaching said vapor/liquid inlet port passes upward through liquid refrigerant in said evaporator tube to evaporate liquid refrigerant from said enclosed liquid/vapor reservoir to reduce superheat of the vaporized refrigerant from the second heat exchange or to trap liquid refrigerant from the second heat exchange within said enclosed liquid/vapor reservoir and said enclosed liquid/vapor reservoir being thermally encapsulated to insulate said enclosed liquid/vapor reservoir from ambient conditions such that the temperature of the liquid refrigerant within said enclosed liquid/vapor reservoir corresponds to the suction pressure of the compressor to control the proper active charge of refrigerant circulatory throughout the heat exchange apparatus.

7. The fluid flow control system of claim 6 wherein said system charge control device further includes a liquid/vapor tube disposed between said vapor/liquid port and said evaporator tube to feed refrigerant from the second heat exchange to the interior of said evaporator tube.

8. The fluid flow control system of claim 6 wherein said system charge control device further includes a fluid velocity reducing means adjacent said evaporator outlet port to reduce the velocity of the refrigerant from said evaporator tube.

9. A fluid flow control system for use with a heat exchange apparatus including a compressor, a first heat exchange to extract heat from the heat exchange apparatus and a second heat exchange to provide heat to the heat exchange apparatus, said fluid flow control system comprising a system charge control device operatively coupled between the compressor and the second heat exchange to regulate the flow of refrigerant therebetween said system charge control device comprises an enclosed liquid/vapor reservoir to retain sufficient liquid refrigerant to provide adequate refrigerant over a range of operating conditions of the heat exchange apparatus, said enclosed liquid/vapor reservoir having a vapor/liquid inlet port formed therein to receive refrigerant from the second heat exchange and a vapor outlet formed therein to supply vapor refrigerant to the compressor and a liquid flow control device operatively coupled between the first and second heat exchanges to regulate the rate of flow of liquid refrigerant therebetween, prevent passage of vapor from the first heat exchange through said liquid flow control device to the second heat exchange such that all refrigerant reaching said vapor/liquid inlet port passes upward through the liquid refrigerant in said enclosed liquid/vapor reservoir to evaporate liquid refrigerant in said enclosed liquid/vapor reservoir to reduce superheat of the vaporized refrigerant from the second heat exchange or to trap liquid refrigerant from the second heat exchange within said enclosed vapor/liquid reservoir and said enclosed liquid/vapor reservoir being thermally encapsulated to insulate said enclosed liquid/vapor reservoir from ambient conditions such that the temperature of the liquid refrigerant within said enclosed liquid/vapor reservoir corresponds to the suction pressure of the compressor to control the proper active charge of refrigerant circulatory within the heat exchange apparatus.

10. The fluid flow control system of claim 9 wherein said liquid flow control device includes a liquid metering means operatively disposed within an enclosed liquid/vapor reservoir, said enclosed liquid/vapor having a liquid inlet port to receive liquid from the first heat exchange and a liquid metering orifice to feed liquid from said enclosed liquid/vapor reservoir, said liquid metering means comprising a movable flow restrictor disposed relative to said liquid metering orifice such that movement of said movable flow restrictor relative to said liquid metering orifice controls the flow rate of liquid through said liquid metering orifice in response to the liquid level within said enclosed liquid/vapor reservoir to regulate the rate of flow of liquid from the first heat exchange.

11. The fluid flow control system of claim 10 wherein said movable flow restrictor comprises a metering member rotatably attached to said enclosed liquid/vapor reservoir such that said metering member rotates relative to the center line axis of said liquid metering orifice in response to the liquid refrigerant level within said enclosed liquid/vapor reservoir to control the effective cross-sectional area of said liquid metering orifice.

12. The fluid flow control system of claim 9 wherein said system charge control device includes an evaporator tube having an orifice formed in the lower portion thereof, an evaporator inlet port and an evaporator outlet port formed on opposite ends of said evaporator tube such that the liquid refrigerant level within said evaporator tube is substantially the same as the liquid refrigerant level within said thermally encapsulated enclosed liquid/vapor reservoir whereby refrigerant entering said inlet port passes through the interior of said evaporator tube thereby trapping any liquid in the refrigerant or reducing superheat of the vapor from said vapor/liquid inlet port by evaporating a portion of the liquid refrigerant within the said evaporator tube.

13. The fluid flow control system of claim 12 wherein said system charge control device further includes a liquid/vapor tube disposed between said vapor/liquid port and said evaporator tube to feed refrigerant from the second heat exchange to the interior of said evaporator tube.

14. The fluid flow control system of claim 12 wherein said system charge control device further includes a fluid velocity reducing means adjacent said evaporator outlet port to reduce the velocity of the refrigerant from said evaporator tube.

15. The fluid flow control system of claim 6 wherein the portion nearest the outlet of said thermally encapsulated enclosed liquid/vapor reservoir is reduced in cross-sectional area relative to the liquid refrigerant storage portion of said thermally encapsulated enclosed liquid/vapor reservoir to provide adequate liquid refrigerant storage within said reservoir and to provide the proper velocity of the refrigerant approaching the said outlet port such that oil/vapor bubbles proceed to exit said outlet port and liquid refrigerant is retained within said thermally encapsulated enclosed liquid/vapor reservoir.

16. The fluid flow control system of claim 12 wherein the portion nearest the outlet of said thermally encapsulated enclosed liquid/vapor reservoir is reduced in cross-sectional area relative to the liquid refrigerant storage portion of said thermally encapsulated enclosed liquid/vapor reservoir to provide adequate liquid refrigerant storage within said reservoir and to provide the proper velocity of the refrigerant approaching the said outlet port such that oil/vapor bubbles proceed to exit said outlet port and liquid refrigerant is retained within said thermally encapsulated enclosed liquid/vapor reservoir.

* * * * *